BEST AVAILABLE COPY

United States Patent [19]

Fröhlich

[11] Patent Number: 4,662,036

[45] Date of Patent: May 5, 1987

[54] SLIDE FASTENER SLIDER

[75] Inventor: Alfons Fröhlich, Essen, Fed. Rep. of Germany

[73] Assignee: Opti Patent-, Forshungs- und Fabrikations - AG, Riedern-Allmeind, Switzerland

[21] Appl. No.: 698,766

[22] Filed: Feb. 6, 1985

[30] Foreign Application Priority Data

Oct. 12, 1984 [DE] Fed. Rep. of Germany ..... 3437467

[51] Int. Cl.[4] ..... A44B 19/30

[52] U.S. Cl. ..... 24/421

[58] Field of Search ..... 24/421, 429, 420

[56] References Cited

U.S. PATENT DOCUMENTS

| | | | |
|---|---|---|---|
| 2,048,636 | 7/1936 | Kotowski | 24/421 |
| 3,068,542 | 12/1962 | Firing | 24/421 |
| 3,070,865 | 1/1963 | Huelster | 24/421 |
| 3,793,684 | 2/1974 | Moertel | 24/421 |
| 3,837,050 | 9/1974 | Takamatsu | 24/421 |
| 3,919,746 | 11/1975 | Fukuroi | 24/421 |
| 4,422,220 | 12/1983 | Oda | 24/421 |

FOREIGN PATENT DOCUMENTS

| | | | |
|---|---|---|---|
| 2504811 | 8/1975 | Fed. Rep. of Germany . | |
| 1377451 | 12/1974 | United Kingdom | 24/421 |

*Primary Examiner*—Peter A. Aschenbrenner

*Attorney, Agent, or Firm*—Karl F. Ross; Herbert Dubno

[57] ABSTRACT

A slide fastener slider has a reversed bend spring member mounted on the slider body and having a spring tongue bend reaching through a window in a fastening portion thereof which is opened in one side. This increases the resilient force with which the tooth or pawl engages the coupling member and also allows the spring element to be thinner than the earlier system in which a sheet metal spring is used.

10 Claims, 5 Drawing Figures

BEST AVAILABLE COPY

BEST AVAILABLE COPY

BEST AVAILABLE COPY

BEST AVAILABLE COPY

SLIDE FASTENER SLIDER

FIELD OF THE INVENTION

My present invention relates to a slide fastener slider and, more particularly, to a slide fastener slider having a molded slide fastener body which is provided with a handle and locking means for retaining the slider at a preset location along a slide fastener stringer.

BACKGROUND OF THE INVENTION

A slide fastener, sometimes commonly referred to as a zipper, generally comprises a pair of slide fastener halves which have respective coupling elements formed along edges of a support such as a tape or the like, to which the coupling elements can be affixed or on which the coupling elements can be formed so, upon movement of a slider along the coupling elements in one direction, respective coupling heads of one coupling element can be pressed between the coupling heads of the other coupling element and vice versa so that the coupling heads are interdigitated, i.e. each coupling head lies in a gap between coupling heads of the other coupling element and is retained against withdrawal from the gap by the head configuration which can include lateral protrusions reaching behind lateral protrusions of the retained head.

Upon movement of the slider in the opposite direction, the coupling elements are urged apart to disengage the heads of the two coupling elements.

The coupling elements may be respective rows of individual coupling members formed with the heads and clamped upon or molded onto a support tape. Alternatively, the coupling heads may be meanders of a continuous synthetic resin monofilament molded with the heads at respective bends of the loops forming the meanders.

In another construction the coupling elements may be coils with the coupling heads formed on or by respective turns of the coil of synthetic resin monofilament.

The attachment of the coupling element to the support tape may be effected in the manner described or by stitching the coupling element onto the tape or weaving or knitting the coupling element onto the tape, or even by passing the heads of the coupling elements through openings formed in the tape.

A pair of slide fastener halves can constitute, with the respective slider, a slide fastener stringer and the slide fastener stringer may form a separable slide fastener or a nonseparable slide fastener. A separable slide fastener has end stop members at one end of the stringer and respective opposite end stop members one of which acts as a stop for the slider and the other of which forms a plug that can be inserted through the slider into the end stop member of the other coupling element to join the slide-fastener halves for closure of the slide fastener upon movement of the slider away from these end stop members.

In a nonseparable slider fastener, the two ends of the stringer are held together by respective end stop-members.

The slider itself can comprise a slider body which generally has the configuration of a pair of shields bridged by a core or heart piece, the latter serving to urge the coupling elements apart when the slider is moved in an opening direction along the coupling elements. The shields straddle the coupling elements and form guides for the latter which press the coupling elements together when the slider is moved in the closing direction.

A pivotal handle may be provided on an upper shield so as to be gripped between fingers of the user for manipulating the slider.

Sliders of this type also can include a spring member having a locking tooth which passes through the upper shield and engages between the coupling heads of the stringer when the handle is in one position to lock the slider against movement. The handle is provided with an eccentric which is effective to withdraw the tooth or pawl from its engagement with the coupling elements when the handle is swung outward to allow movement of the slider along the coupling elements. The spring member is generally retained in the slider body by formations which can engage over edges of the spring member.

In a conventional construction of this type (see German Patent Document DE-OS No. 25 04 811), the fastening elements of the spring member include, in a projection on the slide fastener plane, lateral portions which together with the centrally disposed spring tongue form the tines of a fork projecting from the body. The spring tongue thus effectively functions as a leaf spring supported at one side. As a result, the spring characteristic of the member has generally a low spring force and indeed a spring force which in the locked position is the smallest. This has resulted in attempts to provide inwardly extending bracing members on the support urging the spring element upon the slide fastener body as shown in that patent document.

While this increases the spring force, nevertheless a sufficient spring force requires relatively thick spring plates which may be disadvantageous because they must be held by a proportionally more massive structure and tend to apply increased stress to the slider body, raising the danger of breakage or deformation.

OBJECTS OF THE INVENTION

It is the principal object of the present invention to provide an improved slide fastener slider which has all of the advantages of the spring locking slider previously described but is free from the specified drawbacks and others which may be developed hereinafter.

Another object of this invention is to provide a slide fastener slider which can have its spring member fabricated from comparatively thin sheet metal but yet has an improved spring characteristic and which, especially, provides a significantly larger spring force for retaining the slider in its locked position.

SUMMARY OF THE INVENTION

These objects and others which will become apparent hereinafter are attained, in accordance with the invention, in a slider for a slide fastener stringer which comprises a metal spring forming the locking tooth or pawl in the manner described but which has, in projection upon the slide fastener plane, a substantially C-shaped configuration with one shank of the C being formed as a head portion which is received in a recess in the slide body and the other shank of the C being formed as a foot portion likewise anchored in this body.

A bent leg forms a spring portion extending from the head portion and has its bend reaching up through the laterally open window, i.e. the window framed on only three sides, for engagement by the eccentric of the handle. The pawl or tooth is formed on this bent leg and

BEST AVAILABLE COPY represents the free end of the leg projecting downwardly toward this plane for engagement between the coupling heads.

The foot portion of the spring is held downwardly while all of the remainder of the spring between this foot portion and the eccentric or cam contribute to the spring action biasing the pawl or tooth downward. The head portion may be formed by a bend in one direction or sense while the bend engageable by the cam or eccentric is constituted by a bend in the opposite sense, i.e. a reverse bend structure can be provided to increase resilience.

The cam or eccentric can be a bar formed by or on the head and by means of which the handle is pivotally or swingably mounted on the body. The mounting for this is preferably also disposed within the window of the C along the open side thereof.

Preferably, the foot portion is bent downward and rests in a recess of the body within which the spring is inserted and held in the slider body.

There are numerous advantages to the present invention apart from the one alluded to earlier, namely, the increased spring force which is effective when the pawl or tooth is engaged in the coupling elements.

First, the spring member can be composed of relatively thin sheet metal and thus the tolerance of the slider can be reduced. Notwithstanding the fact that thinner metal is used, a high spring force and excellent spring characteristics can be obtained. The spring force is derived in part from the combination of the two bends and the fact that the two bends are opposite in sense to one another so that they can collectively be referred to as a reverse bend structure.

The spring can be held easily by the slider body and indeed the retaining ledges and recesses of the slider body can be formed unitarily with the remainder thereof by conventional injection molding techniques in one piece. A reason for this is the fact that the ledges need merely engage over the edges of the C-shaped retaining portion of the spring, e.g. the long side thereof opposite the open side of the window and the shank adjacent the window on the open side of the C. The slider body can thus be fabricated completely in the manner described and the spring and the handle automatically mounted thereon using simple equipment.

BRIEF DESCRIPTION OF THE DRAWING

The above and other objects, features, and advantages of the present invention will become more readily apparent from the following description, reference being made to the accompanying drawing in which.

SPECIFIC DESCRIPTION

Figure 1:
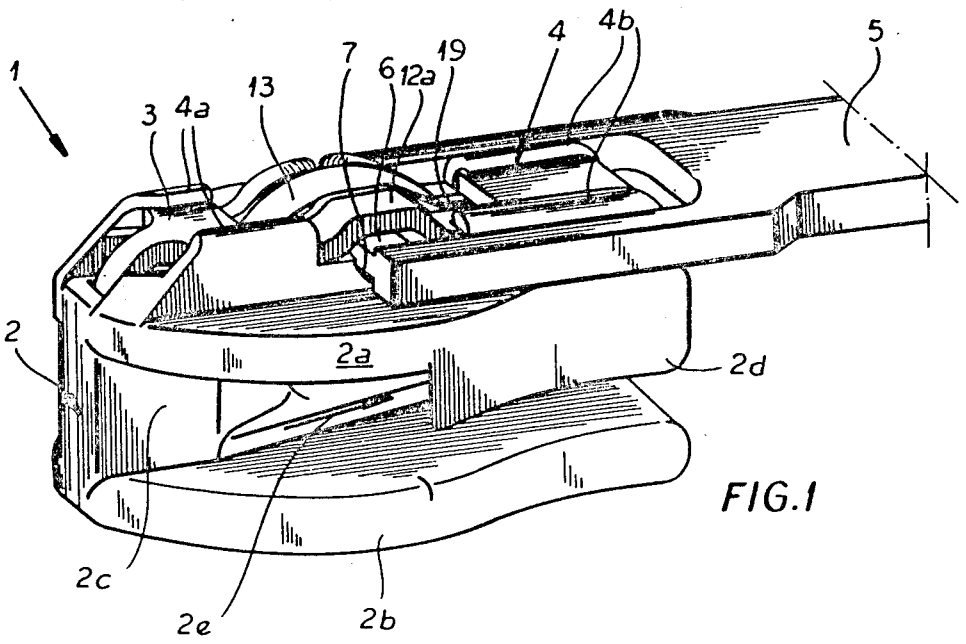
FIG. 1 is a perspective view showing a slider according to the invention with a handle in its lowered position corresponding to a locking engagement of the tooth with the coupling elements of an unillustrated stringer.

From the drawing it will be apparent that a slider 1 for a slide fastener stringer can comprise a slider body 2 equipped with a spring structure 3 which is retained at its edges by a retaining assembly 4 formed on the slider body. The handle 5 comprises a bar 6 which is pivotally mounted in a support 21 via the pivot portion 7 of this bar. The latter carries an eccentric cam 8 which can raise or lower the tooth or pawl 11 of the spring structure.

Figure 5:
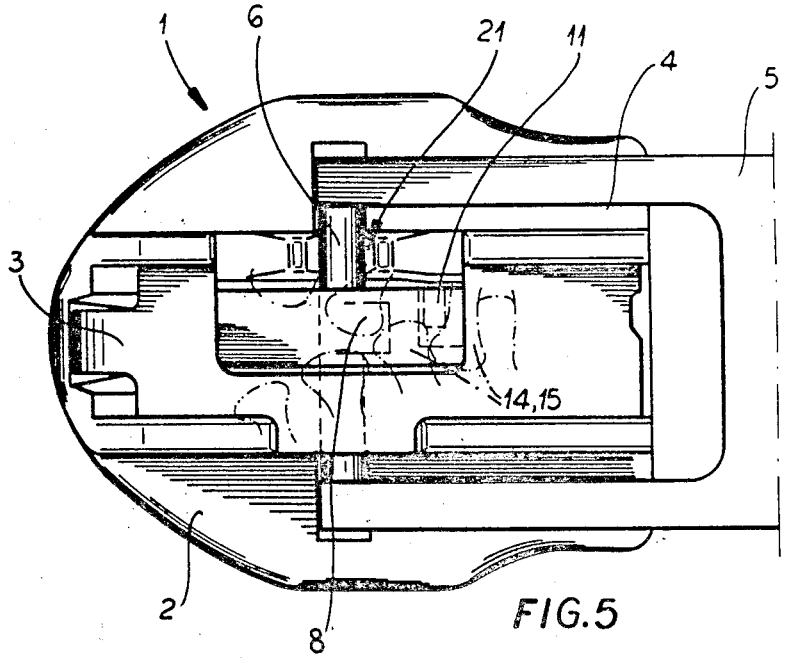
FIG. 5 is a plan view of the slider.

The body 2 of the slider is formed of upper and lower shields **2*a* and 2*b* namely, the upper and lower shields adapted to straddle the slide fastener stringer and formed unitarily with a heart piece or core 2*c*. Tabs 2*d* are provided to define guide channels 2*e* through which the respective coupling elements can pass so that, as shown in dot-dash lines in FIG. 5, the coupling members 14 and 15 can be drawn together when the slider is moved to the left or disengaged from one another when the slider is moved to the right. The retaining assembly 4 can comprise a pair of ledges 4*a* overhanging the edges of the spring assembly at the front end of the slider and a pair of ledges 4*b* overhanging the spring assembly at the rear thereof. A pocket 2*f* is formed in the body 2**, which can be injection molded from a synthetic resin, to receive the head portion of the spring assembly in the manner to be described.

Figure 2:
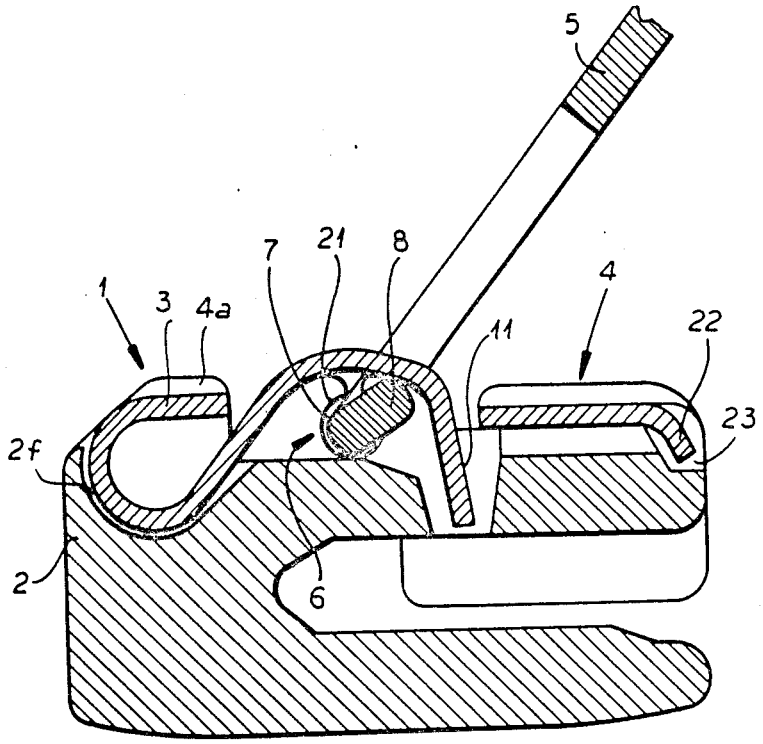
FIG. 2 is a longitudinal section through the slider showing the handle in a position wherein the tooth has been cammed out of engagement with the coupling elements by the eccentric.
Figure 3:
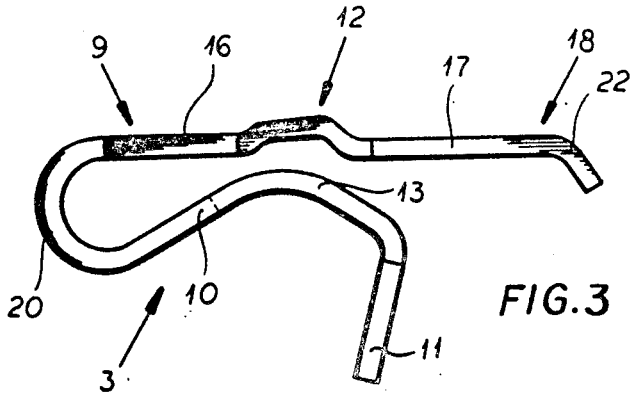
FIG. 3 is a side elevational view of the spring member prior to its mounting on the slider.

The spring assembly 3 comprises a head portion represented generally at 9 from which a spring tongue 10 arises from a bend 20 received in the pocket **2*f*, the tongue 10 being then reversely bent at 13 and having at its free end the tooth or pawl 11 to form a lower leg 10, 11, 13 of the spring 3. This tongue can be deflected upward against its downward resilient bias by the cam or eccentric 8 as shown in FIG. 2 upon swinging movement of the handle 5 into an upright position or outwardly extending position from the position illustrated in FIG. 1. When the handle is released or swung back to its lowered position (FIG. 1) the pawl or tooth 11 engages the coupling heads 14, 15** to lock the slider against movement.

Figure 4:
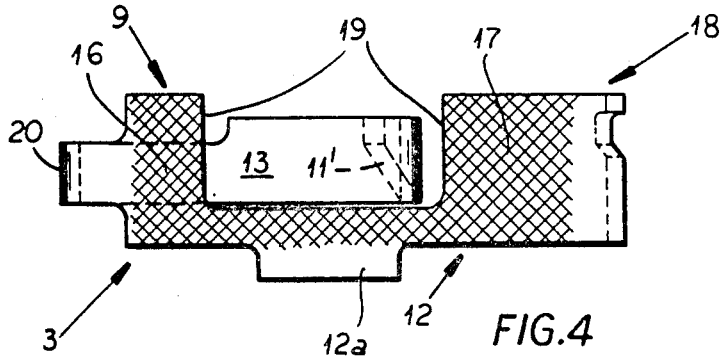
FIG. 4 is a plan view of the spring element, the cross hatching representing the projection thereof on the slide fastener plane which, in the position of the spring elements shown in FIG. 4, is parallel to the plane of the paper of the drawing.

Preferably, the tooth 11 is beveled as represented in FIG. 4 at 11' so that it engages the coupling elements eccentrically, i.e. out of a vertical median plane perpendicular to the slide fastener plane and through the longitudinal axis of the slider.

Important to the invention is the fact that the upper leg 12 of the spring 3, in projection perpendicular to the slide-fastener plane and, as represented by the cross hatched portion of FIG. 4, has a substantially C-shape, i.e. comprises a window 19 which is open to one side (i.e. upward in FIG. 4) and defined by a pair of shanks. The head portion 9 is formed on one of these shanks while the other C shank carries the foot portion 18 which has an apron 22 bent downward at an obtuse angle to engage in a recess 23 formed at the trailing end of the slider.

The spring tongue 10 and its bend 13 are so constructed that the bend 13 extends upward through the window 19 so that the bends 13 and 20 form a reverse-bend relationship, i.e. one bend extending in the counterclockwise sense while the other extends in the clockwise sense.

The bend 13 rests upon the cam 8 and the connecting part 12 of the spring may have a hump **12*a* within which the pivot region 7 of the bar 6** is journaled on the side at which the window is closed, the other side of the bar

BEST AVAILABLE COPY being journaled in a fixed journaling element 21 of the slider body.

Consequently, upon bending of the tongue 10 upward via the cam, practically the entire spring element, running from the foot portion through the head to the tongue at the region it engages the eccentric, can participate in the bending action and can contribute to the resilient force biasing the pawl 11 downward.

I claim:

1. A slider for a slide fastener having a pair of longitudinally extending and laterally interdigitatable rows of coupling members, the slider comprising:

a slider body having an upper shield, a lower shield, and a core connecting the upper and lower shields together, the body being longitudinally displaceable along the rows of coupling members to interdigitate the members on longitudinal movement in one direction and to decouple the members on opposite movement;

a handle swingably mounted on the body about a transverse axis between a lifted position for moving the slider in the direction and a nonactuating position lying atop the slider body, the handle being formed with a cam eccentric to the transverse axis; and a sheet-metal spring on the upper shield having a upper and lower legs connected at a head bend, the upper leg being formed with a window open laterally generally in a longitudinal plane parallel to the direction of movement of the slider, the lower leg having a downwardly projecting spring tongue engageable transverse to the direction in at least one of the elements and a downwardly concave leg bend connecting the tongue to the head bend and protruding upward through the window and over the cam of the handle, the lower leg bearing resiliently downward on the cam, the head bend, spring tongue, and leg bend all being free to flex relative to the body on pivoting of the handle, whereby movement of the handle out of the nonactuating position draws the tongue out of engagement with the coupling members.

2. The slider defined in claim 1, wherein said sheet metal spring is retained on said body by a pair of ledges protruding upward from said upper shield and at least partially engaging over edges of the upper leg.

3. The slider defined in claim 2 wherein said bend connecting said head bend to said spring tongue is bent in a sense opposite the head bend, whereby said bends form a reverse bend structure.

4. The slider defined in claim 3 wherein said body is formed with a pocket receiving the head bend.

5. The slider defined in claim 4 wherein said body is formed with a journal adjacent said pocket, engaging said handle, and enabling pivotal displacement thereof.

6. The slider defined in claim 5 wherein said journal is immediately adjacent said window.

7. The slider defined in claim 6 wherein said connecting part is formed with an downwardly concave hump centered on the axis, rotatively supporting said handle, and opposite said journal.

8. The slider defined in claim 7 wherein said handle is provided with a bar extending between said hump and said journal and carrying the eccentric cam.

9. The slider defined in claim 8 wherein said spring tongue has a beveled end engageable in at least one of the coupling members.

10. The slider defined in claim 1 wherein the upper leg is formed with a foot having a downwardly bent end received in a recess formed at a trailing end of said slider body.

* * * * *